US007142803B2

(12) United States Patent
Koyama et al.

(10) Patent No.: US 7,142,803 B2
(45) Date of Patent: Nov. 28, 2006

(54) FIXING DEVICE AND IMAGE FORMING APPARATUS

(75) Inventors: Tuyoshi Koyama, Ibaraki (JP); Toshio Ogiso, Ibaraki (JP); Chikara Hiraoka, Ibaraki (JP); Kazuo Kikuchi, Ibaraki (JP); Tetsuji Takegoshi, Ibaraki (JP); Toru Hanashima, Ibaraki (JP); Shoji Ukei, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 0 days.

(21) Appl. No.: 11/011,501

(22) Filed: Dec. 15, 2004

(65) Prior Publication Data

US 2005/0147436 A1 Jul. 7, 2005

(30) Foreign Application Priority Data

Dec. 19, 2003 (JP) ..... P 2003-422405

(51) Int. Cl.
*G03G 15/20* (2006.01)

(52) U.S. Cl. ..... 399/329; 219/216

(58) Field of Classification Search ..... 399/29, 399/107, 122, 320, 328, 329; 219/216
See application file for complete search history.

(56) References Cited

U.S. PATENT DOCUMENTS

| | | | | |
|---|---|---|---|---|
| 5,300,999 | A * | 4/1994 | Koh et al. | 399/329 |
| 6,895,208 | B1 * | 5/2005 | Nakatogawa et al. | 399/329 |
| 6,928,257 | B1 * | 8/2005 | Ogiso et al. | 399/329 |
| 6,944,420 | B1 * | 9/2005 | Kanamori et al. | 399/329 |
| 2003/0108360 | A1 * | 6/2003 | Ogasawara | 399/159 |
| 2004/0057759 | A1 * | 3/2004 | Ogiso et al. | 399/329 |
| 2004/0131401 | A1 * | 7/2004 | Nakatogawa et al. | 399/328 |

FOREIGN PATENT DOCUMENTS

| | | |
|---|---|---|
| DE | 694 18 992 T 2 | 9/1999 |
| DE | 694 16 843 T 2 | 11/1999 |
| JP | 09-044008 | 2/1997 |
| JP | 09-292790 | 11/1997 |
| JP | 11-219052 | 8/1999 |
| JP | 2001-228731 | 8/2001 |
| JP | 2003-191389 | 7/2003 |
| JP | 2004-29611 | 1/2004 |
| JP | 2004-37764 | 2/2004 |
| JP | 2004-206105 | 7/2004 |

OTHER PUBLICATIONS

Korean Office Action dated Mar. 30, 2006 (with translation).
German Office Action dated Dec. 19, 2005, with English Translation.

* cited by examiner

*Primary Examiner*—Hoan Tran
(74) *Attorney, Agent, or Firm*—McGinn IP Law Group, PLLC

(57) ABSTRACT

A fixing device includes a roller; an endless belt which is in contact with the roller and rotates with a circulation of the roller in a follower manner; a heating source in at lease one of an inside of the roller and an inside of the endless belt; and a pressure-applying member which is inside the endless belt and presses the endless belt against the roller. A sliding layer is provided on a side on which the pressure-applying member is in contact with the endless belt, and the sliding layer comprises at least two layers and holds a lubricant.

20 Claims, 2 Drawing Sheets

FIXING DEVICE AND IMAGE FORMING APPARATUS

BACKGROUND OF THE INVENTION

1. Field of the Invention

The present invention relates to a belt fixing device which fixes an unfixed toner held on a recording medium such as paper or an OHP sheet based on print data and an image forming apparatus provided with the belt fixing device.

2. Description of the Related Art

In an image forming apparatus provided with a belt fixing device such as a laser beam printer, it is essential to stably drive a belt for a long period of time.

As for a conventional technique, there is a case in which an article in which a porous resin film is laminated on a surface of a porous resin fiber woven fabric or a porous resin fiber woven fabric is used as a low friction sheet and silicon oil is used as a lubricant (see JP-A-2001-228731). However, since a void in a pressed portion of a porous resin is crushed and the lubricant is pushed out, a lean state of the lubricant is generated. Therefore, a load torque is increased in proportion to a size of an area of the portion in which the lubricant is lean. Ordinarily, most fibers are non-porous resin fibers. In order to allow them to be porous, there is a method in that they are allowed to be a foamed body or they are biaxially stretched since they do not become porous by monoaxial stretching. However, in any of such cases as described above, at the time of forming the fibers, they are apt to be cut starting from the void (crack) and, accordingly, productivity is deteriorated. For this account, there is a problem in that the porous resin fibers appear to be higher in cost than ordinary non-porous resin fibers. Further, there is a problem in that the silicon oil evaporates a low molecular weight siloxane component under a high temperature.

On the other hand, there is a case in which a sheet-like sliding material comprising a porous-structure material or the porous-structure material laminate-bonded with a porous film on a sliding face side and a deformation preventive film laminate-bonded on a non-sliding face side is used while silicone oil is used as the lubricant (see JP-A-2003-191389). However, the sheet-like sliding material laminate-bonded with the deformation preventive film becomes higher in cost by such laminate-bonding. Further, since the silicone oil is high in flowability, it tends to be diffused into other portions through permeation unless a deformation preventive film concurrently serving as an oil barrier is provided. When the silicon oil is diffused, it may contaminate other devices or deplete the lubricant on the sliding face to cause an increase of the load torque. Still further, there is a problem in that the low molecular weight siloxane component is evaporated under a high temperature.

One of technical problems concerning the belt fixing device is to stably drive the belt in a long period of time. When a frictional force between the belt and a sliding layer is high, the load torque becomes large to invite a breakage of a sliding portion or damage a surface of a roller. When an effective contact area ratio of a pressed portion of the sliding layer becomes large, the load torque tends to be increased. Further, when an oil holding ratio of the sliding sheet is small, there is a problem in that the lubricant is seeped out and enter between the roller and the belt to cause a slip of the belt, or the lubricant is depleted in the sliding portion in a long-hour driving to cause a sharp increase of the load torque. When the belt is slipped, a transportation speed of sheets is reduced to cause a problem such as folding of paper or disturbance of an image.

Further, since the sliding sheet or the lubricant is subjected to a high temperature for a long period of time, there is a possibility in that thermal degradation thereof is progressed. When the sliding sheet is thermally fused, it stuck to an inside of the belt to cause an increase of the load torque or emission of an offensive odor. When the lubricant is degraded by being oxidized, it is carbonized or becomes thick to increase the frictional force. Further, when the evaporated siloxane is adsorbed in a current-applied portion, there is a possibility of causing an electric hindrance.

SUMMARY OF THE INVENTION

In a fixing device adopted an endless belt, when a frictional force between the belt and the sliding layer is high, the load torque becomes large to sometimes cause a breakage of a driving portion or a damage of the surface of the roller. Further, when the oil holding ratio of the sliding layer is small, a problem is sometimes generated in that the lubricant is seeped out and enter between the roller and the belt to cause a slip of the belt, or the lubricant is depleted in the sliding portion in a long-hour driving to cause a sharp increase of the load torque.

According to a first aspect of the invention, a fixing device includes: a roller; an endless belt which is in contact with the roller and rotates with a circulation of the roller in a follower manner; a heating source in at least one of an inside of the roller and an inside of the endless belt; and a pressure-applying member which is inside the endless belt and presses the endless belt against the roller, in which a sliding layer is provided on a side on which the pressure-applying member is in contact with the endless belt, and the sliding layer comprises at least two layers and holds a lubricant.

According to a second aspect of the invention, an image forming apparatus includes a photoreceptor forming electrostatic latent images; a developing device which develops the electrostatic latent images with a toner of yellow, magenta, cyan and black on the photoreceptor; an intermediate transfer device which stacks the toner images; a transfer device which transfers the toner images stacked on the intermediate transfer body to a recording medium; and a fixing device which fixes the toner images onto the recording medium. The fixing device includes: a roller; an endless belt which is in contact with the roller and rotates with a circulation of the roller in a follower manner; a heating source in at least one of an inside of the roller and an inside of the endless belt; and a pressure-applying member which is inside the endless belt and presses the endless belt against the roller, in which a sliding layer is provided on a side on which the pressure-applying member is in contact wit the endless belt, and the sliding layer comprises at least two layers and holds a lubricant.

According to the invention, by allowing the sliding layer of the fixing device to comprise two layers, a holding property of the lubricant comes to be excellent and sliding frictional resistance with the endless belt can be reduced.

DETAILED DESCRIPTION OF THE PREFERRED EMBODIMENTS

Hereinafter, an embodiment according to the present invention is described with reference to drawings.

Figure 5:
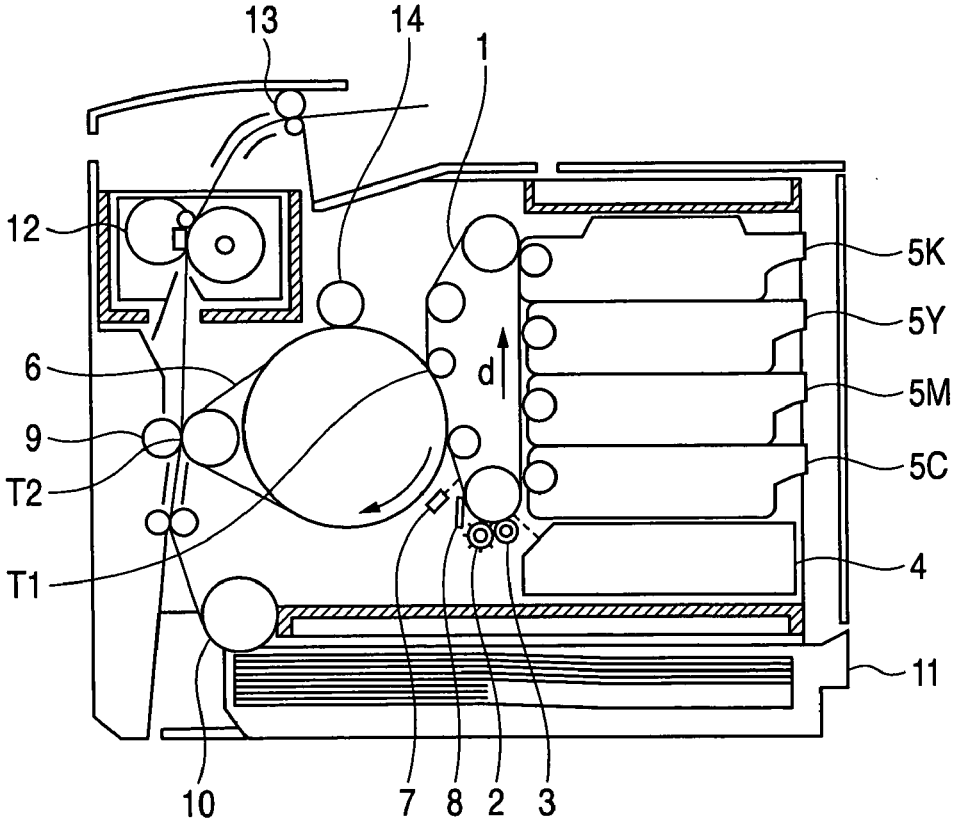
FIG. 5 is an entire constitution of an image forming apparatus.

Firstly, an entire constitution of an image forming apparatus will be described with reference to FIG. 5. In FIG. 5, the reference numeral 1 denotes a photoreceptor belt which is supported in a direction indicated by an arrow d in an endlessly transferable manner. The reference numeral 2 denotes a charging brush, the reference numeral 3 denotes a charging roller. The charging brush 2 and the charging roller 3 are provided in contact with a surface of the photoreceptor belt 1, and the surface of the photoreceptor belt 1 is uniformly charged. An exposure device 4 which irradiates light on the thus-uniformly-charged surface of the photoreceptor belt 1 exposes the photoreceptor belt 1 by a device of dot in accordance with image or letter data obtained by a personal computer, an image scanner or the like, to thereby form an electrostatic latent image on the surface of the photoreceptor belt 1.

The electrostatic latent image formed on the surface of the photoreceptor belt 1 is supplied with a toner by any one of a developing device 5K for a black toner, a developing device 5Y for a yellow toner, a developing device for a magenta toner and a developing device 5C for a cyan toner and, thereafter, developed into a toner image which is, then, transported to a first transfer position T1. At the first transfer position T1, by a voltage difference between the photoreceptor belt 1 and an intermediate transfer body 6, the toner image on the photoreceptor belt 1 is transferred to a surface of the intermediate transfer body 6.

By irradiating the surface of the photoreceptor belt 1 which passes through the first transfer position T1 by light from a residual-image removing device 7, a voltage thereof is reduced to a given value or less, to thereby remove the electrostatic latent image therefrom. Subsequently, the toner remaining on the photoreceptor belt 1 without being transferred at the first transfer position T1 is removed by a cleaning device 8, to thereby allow the surface of the photoreceptor belt 1 to be in a state in which a next image can be formed.

By repeating such step as described above required times by each of the developing devices 5K, 5Y, 5M and 5C, the toner image corresponding to the image or letter data is formed on the surface of the intermediate transfer body 6.

Thereafter, the toner image transferred on the intermediate transfer body 6 is transferred at a second transfer position T2 by a transfer device 9 onto a recording medium supplied by a recording medium supplying device 10 from a cassette 11.

The recording medium on which the toner image is transferred is released from the intermediate transfer body 6, transported to a fixing device 12 and, after the toner image thereon is fixed there, discharged by a recording medium discharge device 13.

Further, the reference numeral 14 in FIG. 5 denotes the cleaning device for cleaning the surface of the intermediate transfer body 6.

Next, a constitution of the fixing device 12 will be described in detail with reference to FIG. 1.

Figure 1:
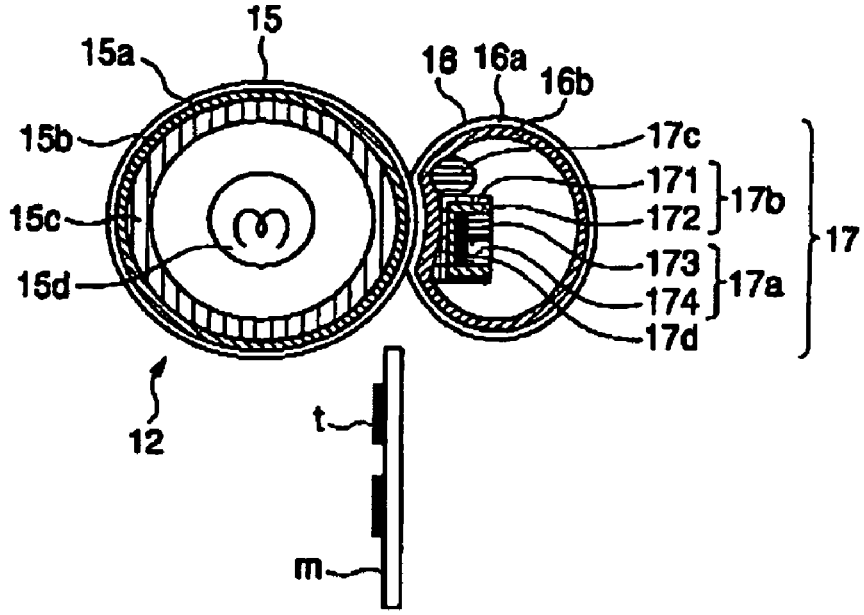
FIG. 1 is a cross-sectional view of a fixing device applicable to an image forming apparatus according to the present invention.

As shown in FIG. 1, a roller 15 of the fixing device 12 comprises a toner parting layer 15*a*, an elastic layer 15*b* and a support 15*c*. It is preferable that the toner parting layer 15*a* comprises a fluorine resin or a fluorine rubber such as PFA or PTFE, the elastic layer 15*b* comprises a silicone rubber or a fluorine rubber and the support 15*c* is made of metal such as aluminum or iron.

Further, the endless belt 16 comprises a surface 16*a* and a substrate 16*b*. It is preferable that the surface layer 16*a* comprises a fluorine resin or a fluorine rubber such as PFA or PTFE and the substrate layer 16*b* comprises a resin such as polyimide or polyamidoimide.

A pressure-applying member 17 is constituted by a pressing member 17*a*, a sliding material 17*b* and, optionally, a releasing roller 17*c*.

The pressing member 17*a* is permissible so long as it has a thermal resistance to a working temperature and is an inorganic or organic material capable of transmitting a pressure; for example, inorganic materials such as ceramic, glass and aluminum, rubbers such as a fluorine rubber, fluorine resins such as PTFE (tetrafluoroethylene), PFA (a tetrafluoroethylene perfluoroalkoxy vinyl ether copolymer), ETFE (an ethylene tetrafluoroethylene copolymer), FEP (a tetrafluoroethylene hexafluoropropylene copolymer), resins such as PI (polyimide), PAI (polyamidoimide), PPS (polyphenylene sulfide), PEEK (polyether ether ketone), LCP (liquid plastic), a phenol resin, resins such as nylon and aramid, and combinations thereof can be used.

For the purpose of reducing a frictional force, the lubricant between the endless belt 16 and the sliding layer 17*b* comprises a modified perfluoropolyether. For example, a carboxylic acid-modified perfluoropolyether, a phosphoric acid-modified perfluoropolyether, an alcohol-modified perfluoropolyether, an amide-modified perfluoropolyether or the like is used. By adding the modified perfluoropolyether to the lubricant, the load torque of the belt fixing device can be reduced for a long period of time.

Further, in order to prevent the oil from seeping out or diffusing to other members, the lubricant may be added with a thickening agent to enhance a holding property of an oil component. As for such thickening agents, Benton, silica gel, urea, PTFE, molybdenum disulfide, glass, carbon, BN and the like are used. Particularly, a PTFE grain which has a high compatibility to the modified perfluoropolyether and does not impair the slidability is preferred. By adding the thickening agent to the lubricant, diffusion of the oil component can be prevented.

A material of the sliding layer 17*b* is permissible so long as it is an inorganic or organic material which has a thermal resistance to a working temperature, can transmit a pressure and is appropriate for sliding; for example, inorganic materials such as ceramic, glass and aluminum, rubbers such as a silicone rubber and a fluorine rubber, fluorine resins such as PTFE, PFA, ETFE and FEP, resins such as PI, PAI, PPS, PEEK, LCP, a phenol resin, resins such as nylon resin and aramid, and combinations thereof can be used.

Further, in order to attain reduction of the friction at a low cost, a structure of the sliding layer 17*b* is allowed to be of a two-layer structure and, then, a layer 172 on the side of being in out of contact with the inside of the endless belt 16 is constituted by a woven fabric or non-woven fabric comprising a PPS fiber, an aramid fiber, a nylon fiber or the like which is high in a lubricant holding property, while a layer 171 on the side of being in contact with the inside of the endless belt 16 is constituted by a woven fabric or non-woven fabric comprising a fluorine fiber of PTFE, PFA, ETFE, FEP or the like, in order to reduce the sliding resistance.

Particularly, the layer 172 is preferably of a felt structure having a high oil-component holding property while the layer 171 is preferably of a woven fabric structure which has a small effective contact area ratio. On this occasion, in order to facilitate transfer of the lubricant held in the layer 172 to the layer 171, the layer 172 is preferably of a fiber structure instead of a film which blocks off the lubricant and it is preferable that faces of two layers of the sliding layer 17*b* are not laminate-bonded with each other. Further, the effective contact area ratio of the layer 171 is preferably 20% or less under a pressure of 0.12 MPa.

Further, so long as such effect as described above is achieved, the sliding layer may comprise two or more layers.

The effective contact area ratio on this occasion is a ratio of an area obtained by subtracting a sum of void portion areas in the sliding layer 17*b* which do not contribute to pressure transmission from an apparent contact area between the endless belt 16 and the sliding layer 17*b* under a pressure and is represented by the following formula (1):

$$\text{Effective contact area ratio}=(\text{apparent contact area}-\text{void portion area})/(\text{apparent contact area})\times 100 \quad (1).$$

A method for measuring the effective contact area may be performed based on the formula (1). The method can nearly be paraphrased as described below. Namely, immediately after the layer 171 is pressed on a stamp pad (available as MEDIUM SIZE HG-2EC BLACK from Shachihata Inc.) with a pressure of 0.12 MPa, a black ink (available as SG-40 BLACK from Shachihata Inc.) attached thereon is transferred to a blank sheet (available as FINE FC available from Kishu Paper Co., Ltd.) by a pressing operation with a pressure of 0.12 MPa. Then, the resultant image formed by such transfer is converted to output signals by an optical microscope (available as VH-8000 from Keyence Corp.) and, thereafter, an effective contact area in which the black ink is attached and a void area in which the black ink is not attached on the sheet are separately computed by arithmetic processing.

Figure 2:
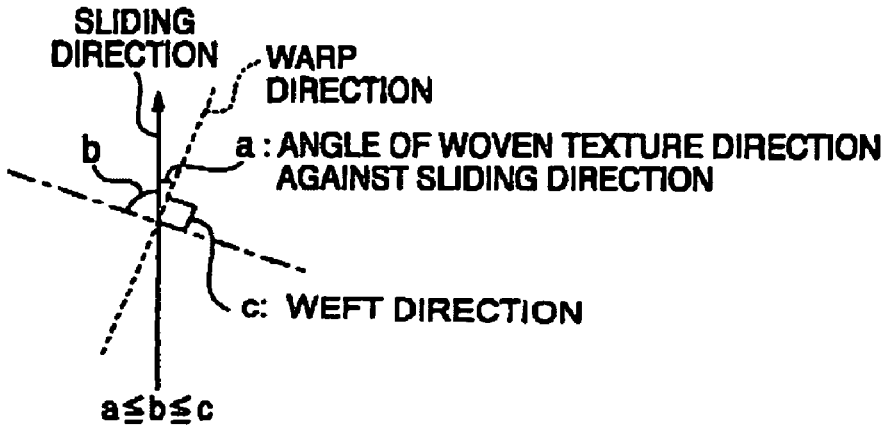
FIG. 2 is an explanatory view showing a relation of a sliding direction of a sliding layer against an angle of a woven texture direction.

A direction of the layer 171 to be aligned is not particularly limited so long as it is in an angle in which deformation of a woven texture comes to be small. Particularly, an angle formed by a woven texture direction and a sliding direction is preferably in the range of from 30° to 45°. The term "angle formed by a woven texture direction and a sliding direction" as used herein is intended to indicate, as shown in FIG. 2, a minimum angle a among 3 angles a, b and c in total formed among a warp direction and a weft direction of the sliding layer on the side with which the endless belt 16 is in contact and the sliding direction from an intersection point there among.

In FIG. 1, in order to facilitate the image medium m subjected to a fixing operation to be released from the roller 15, are leasing roller 17*c* may be provided. There leasing roller 17*c* preferably is a metal roller of stainless steel or the like or a rubber roller, in which a metallic core solid is covered with a fluorine rubber, a silicone rubber or the like, which has a thermal resistance to a working temperature, can transmit a pressure and rotates with a circulation of the endless belt 16 in a follower manner. Further, heating sources 15*d* and 17*d* are arranged in at least one of an inside of the roller 15 and an inside of the endless belt 16 such that a pressed portion (hereinafter, referred to also as nip portion) between the roller 15 and the endless belt 16 is heated. The heating sources may singly be provided in one of the inside of the roller 15 and the inside of the endless belt 16. As for the heating sources, for example, a halogen lump, an electromagnetic induction-type heating source, a PTC heater, a film heater and a ceramic heater can be used. An unfixed toner t attached to the recording medium m is heated, pressed and, then, fixed on the recording medium m while it passes through the nip portion formed by the roller 15 and the endless belt 16.

Hereinafter, specific embodiments will be described with reference to FIGS. 1, 3 and 4, and Table 1.

EXAMPLE 1

In regard to a roller 15, a PFA tube having a thickness of 30 μm was used as a toner parting layer 15*a*; a silicone rubber having a thickness of 0.6 mm and a hardness of 20° (Shore hardness A) was used as an elastic layer 15*b*; and a cylinder made of aluminum having a thickness of 1 mm and a diameter of 40 mm was used as a support 15*c*.

In regard to an endless belt 16, a PFA tube having a thickness of 30 μm was used as a surface layer 16*a*; and a polyimide belt having a thickness of 50 μm and a diameter of 30 mm was used as a substrate 16*b*.

In regard to a pressure-applying member 17, an aluminum pad 173 and a silicone rubber pad 174 having a hardness of 20° (Shore hardness A) and a thickness of 4 mm was used as a pressing member 17*a*; a fluorine felt (available from Toray Industries, Inc.) having a thickness of 0.8mm was used as a sliding layer 17*b*; and a roller made of stainless steel having a diameter of 8 mm was used as a releasing roller 17*c*.

In regard to a heating source, a halogen lump of 980 W was used as a heating source 15*d* inside the roller 15; and a film heater was used as a heating source 17*d* inside the endless belt 16.

A carboxylic acid-modified perfluoropolyether added with PTFE grains having an average grain diameter of 0.3 μm (available as LUBRON L-2 from Daikin Industries, Ltd.) was used as a lubricant.

A total load of 30 kgf was placed on the pressure-applying member 17.

A nip portion was heated by a halogen lump 15*d* at 160° C. and set to be at a peripheral speed of 200 mm/second.

Figure 3:
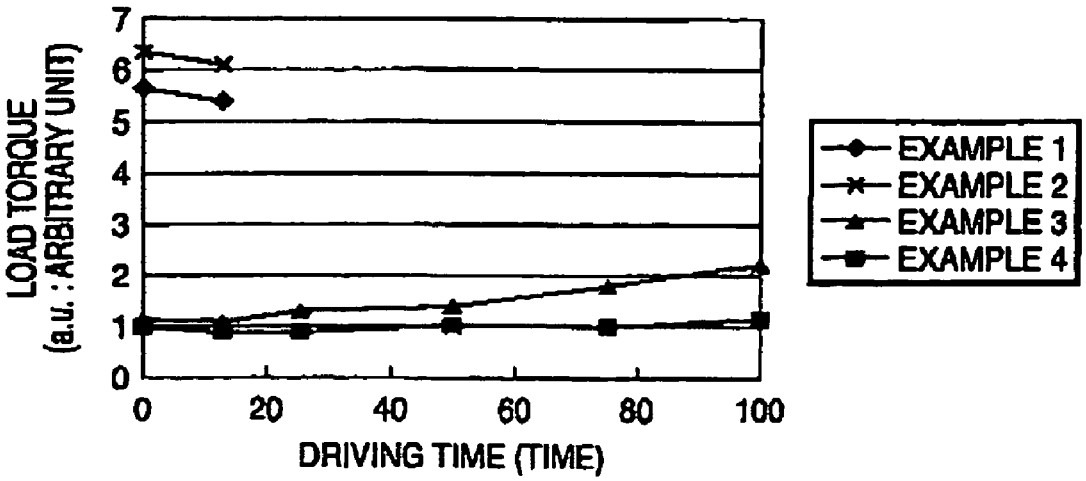
FIG. 3 is a graph showing a relation of a driving time against a load torque of a fixing device.

An oil component holding ratio and an effective contact area ratio of the sliding layer 17*b* are shown in Table 1 and changes along the passage of time are shown in FIG. 3. On this occasion, the term "oil component holding ratio" indicates an oil remaining ratio of oil remained after vertically leaving standstill the sliding layer 17*b* having a size of 30 mm long×18 mm wide infiltrated only with 0.5 g of a fluorine oil component (available as S65 from Daikin Industries, Ltd.) for 200 hours at room temperature.

As shown in Table 1, according to Example 1, the oil component holding ratio was 78% and the effective contact area ratio was 25%. Further, the load torque in the above case was 5.5 (a.u.: arbitrary unit) when a driving time duration was 12.5 hours.

EXAMPLE 2

Same procedures as in Example 1 were performed except that a layer 172 on the side of being not in contact with an endless belt 16 was changed into an aramid felt having a thickness of 0.4 mm and a layer 171 on the side of being in contact with the endless belt 16 was changed into a porous PTFE film (available as POREFLON from Sumitomo Electric Industries, Ltd.)

According to Example 2, an oil component holding ratio was large as 86% while an effective contact area ratio was extremely large as 99%. The load torque in the above case was 6.1 (a.u.) when a driving time duration was 12.5 hours.

EXAMPLE 3

Same procedures as in Example 1 were performed except that a layer 172 on the side of being not in contact with an endless belt 16 was changed into a PTFE woven fabric (available as No. 406W from Toray Industries, Inc.) having a thickness of 0.4 mm and a layer 171 on the side of being in contact with the endless belt 16 was changed into a PFA net (available from Toray Industries, Inc.) and, also, a woven texture direction was changed to 45° against a sliding direction.

According to Example 3, an oil component holding ratio was small as 25% while an effective contact area ratio was extremely small as 1%. The load torque in the above case was 1.1 (a.u.) when a driving time duration was 12.5 hours. Although this value was lower than those in Examples 1 and 2, it was increased to 2.2 when the driving time duration was 100 hours.

EXAMPLE 4

Same procedures as in Example 1 were performed except that a layer 172 on the side of being not in contact with an endless belt 16 was changed into an aramid felt (available from Fuji Corp.) having a thickness of 0.4 mm and a layer 171 on the side of being in contact with the endless belt 16 was changed into a PFA net (available from Toray Industries, Inc.) and, also, a woven texture direction was changed to 45° against a sliding direction.

According to Example 4, an oil component holding ratio was large as 79% while an effective contact area ratio was extremely small as 1%. The load torque in the above case was small as 1.0 (a.u.) compared with those in Examples 1 to 3 when a driving time duration was 12.5 hours and maintained such a small value as 1.1 (a.u.) for a long period of time even when the driving time duration was 100 hours.

TABLE 1

| | Example 1 | Example 2 | Example 3 | Example 4 |
|---|---|---|---|---|
| Oil component holding ratio (%) | 78 | 86 | 25 | 79 |
| Effective contact area ratio (%) | 25 | 99 | 1 | 1 |

A method for measuring a woven texture direction and a deformation amount of the woven texture of a PFA net will be described below.

The PFA net having a thickness of 0.2 mm (available from Toray Industries, Ltd.) was cut to a size of 50 mm long×100 mm wide and, then, the resultant PFA net was stretched in a transverse direction under such conditions as each chuck area: 100 $mm^2$; distance between chucks: 10 mm; tension: 5 kg and, then, a deformation amount of the woven texture was measured. The results are shown in FIG. 4.

Figure 4:
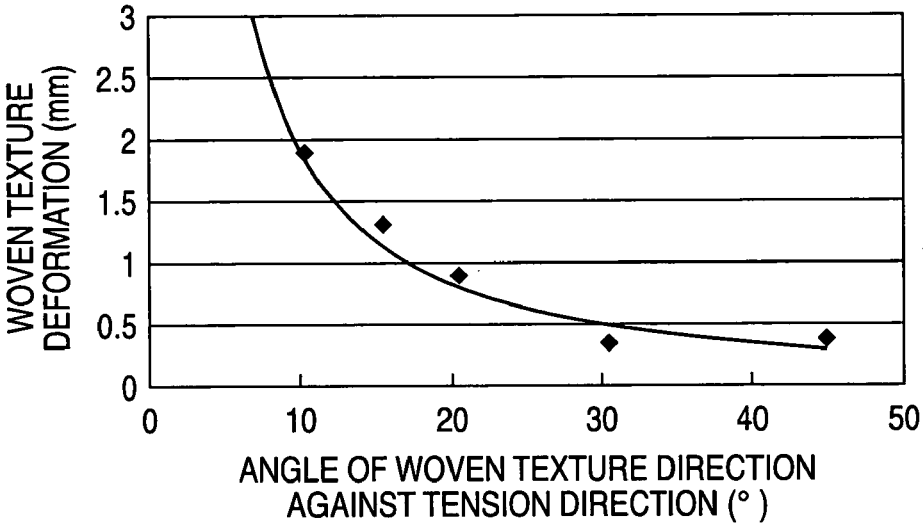
FIG. 4 is a graph showing a relation of a woven texture direction against a deformation amount of a woven texture.

From FIG. 4, it has been found that, when an angle formed between the woven texture direction and a tension direction was in the range of from 30° to 45°, the deformation of the woven texture was small. Further, when the angle formed between the woven texture direction and the tension direction was 0°, the PFA net was fractured. In such a manner as described above, by setting the angle of the woven texture direction against the sliding direction to be in the range of from 30° to 450°, the deformation of the woven texture can be reduced.

Further, the above description has so far been made on the image forming apparatus constituted, as an illustrative example, such that a toner image formed on a belt-like photoreceptor was primarily transferred to an intermediate transfer body and, then, the toner image thus transferred on the intermediate transfer body was secondarily transferred to a recording medium such as a blank sheet. However, a constitution of the image forming apparatus is not limited to that described above and the photoreceptor may be in a drum shape. Further, a constitution in which a transfer device is provided facing to the photoreceptor and the toner is transferred from the photoreceptor directly to the recording medium without passing through the intermediate transfer body may be applicable to the image forming apparatus.

A lubricant and a sliding layer according to the invention are also applicable to OA apparatuses, automotive vehicles, measuring instruments, construction materials and, also, other industrial apparatuses than those described above as friction reduction materials for a press-contacted sliding face.

What is claimed is:

1. A fixing device comprising:

a roller;

an endless belt which is in contact with the roller and rotates with a circulation of the roller in a follower manner;

a heating source in at least one of an inside of the roller and an inside of the endless belt; and a pressure-applying member which is inside the endless belt and presses the endless belt against the roller, said pressure-applying member comprising:

a sliding layer provided on a side of the pressure-applying member and comprising a layer in contact with said endless belt, and a layer out of contact with said endless belt for holding a lubricant and transferring said lubricant to said layer in contact with said endless belt.

2. The fixing device according to claim 1, wherein the lubricant comprises a modified perfluoropolyether.

3. The fixing device according to claim 2, wherein the modified perfluoropolyether comprises at least one chemical selected from the group consisting of a carboxylic acid-modified perfluoropolyether, a phosphoric acid-modified perfluoropolyether, an alcohol-modified perfluoropolyether, and an amide-modified perfluoropolyether.

4. The fixing device as set forth in claim 1, wherein the lubricant includes a polytetrafluoroethylene (PTFE) grain.

5. The fixing device according to claim 1, wherein layer in contact with the endless belt includes a fluorine fiber layer, and the layer out of contact with the endless belt includes at least one fiber selected from the group consisting of an aramid fiber, a polyphenylene sulfide (PPS) fiber, and a nylon fiber.

6. The fixing device according to claim 5, wherein the layer out of contact with the endless belt comprises a felt layer.

7. The fixing device according to claim 5, wherein the fluorine fiber layer comprises a woven fabric and an angle of a woven texture direction of the fluorine fiber against a sliding direction of the fluorine fiber is in the range of from 30° to 45°.

8. The fixing device according to claim 1, wherein the sliding layer has an effective contact area ratio of a face being in contact with the endless belt of 20% or less under a pressure of 0.12 MPa.

9. The fixing device according to claim 1, wherein said layer in contact with said endless belt and said layer out of contact with said endless belt comprise other than laminate-bonded layers.

10. The fixing device according to claim 1, wherein said layer out of contact with said endless belt comprises a fiber structure.

11. The fixing device according to claim 1, wherein said layer in contact with said endless belt comprises a woven fabric having an angle of a woven texture direction against a sliding direction in the range of from 30° to 45°.

12. An image forming apparatus comprising:

a photoreceptor forming electrostatic latent images;

a developing device which develops the electrostatic latent images with a toner of yellow, magenta, cyan and black on the photoreceptor;

an intermediate transfer device which stacks the toner images;

a transfer device which transfers the toner images stacked on the intermediate transfer body to a recording medium; and a fixing device which fixes the toner images onto the recording medium, wherein the fixing device comprises:

a roller;

an endless belt which is in contact with the roller and rotates with a circulation of the roller in a follower manner;

a heating source in at least one of an inside of the roller and an inside of the endless belt; and a pressure-applying member which is inside the endless belt and presses the endless belt against the roller, said pressure-applying member comprising:

a sliding layer provided on a side of the pressure-applying member and comprising a layer in contact with said endless belt, and a layer out of contact with said endless belt far holding a lubricant and transferring said lubricant to said layer in contact with said endless belt.

13. The image forming apparatus according to claim 12, wherein the lubricant comprises a modified perfluoropolyether.

14. The image forming apparatus according to claim 13, wherein the modified perfluoropolyether includes at least one chemical selected from the group consisting of a carboxylic acid-modified perfluoropolyether, a phosphoric acid-modified perfluoropolyether, an alcohol-modified perfluoropolyether, and an amide-modified perfluoropolyether.

15. The image forming apparatus according to claim 12, wherein the lubricant includes a polytetrafluoroethylene (PTFE) grain.

16. The image forming apparatus according to claim 12, wherein the layer in contact with the endless belt includes a fluorine fiber layer, and the layer out of contact with the endless belt includes at least one fiber selected from the group consisting of an aramid fiber, a polyphenylene sulfide (PPS) fiber, and a nylon fiber.

17. The image forming apparatus according to claim 16, wherein the layer out of contact with the endless belt comprises a felt layer.

18. The image forming apparatus as set forth in claim 16, wherein the fluorine fiber layer comprises a woven fabric and an angle of a woven texture direction of the fluorine fiber against a sliding direction of the fluorine fiber is in the range of from 30° to 45°.

19. The image forming apparatus as set forth in claim 12, wherein the sliding layer has an effective contact area ratio of a face being in contact with the endless belt of 20% or less under a pressure of 0.12 MPa.

20. A sliding layer for a member applying pressure to an endless belt, comprising:

a layer in contact with said endless belt; and a layer out of contact with said endless belt for holding a lubricant and transferring said lubricant to said layer in contact with said endless belt.

* * * * *